US006931676B1

(12) United States Patent
Henley, Jr.

(10) Patent No.: US 6,931,676 B1
(45) Date of Patent: Aug. 23, 2005

(54) CORNER BED ARRANGEMENT

(76) Inventor: E. Patrick Henley, Jr., 617-A Fifth Ave., Greensboro, NC (US) 27405

( * ) Notice: Subject to any disclaimer, the term of this patent is extended or adjusted under 35 U.S.C. 154(b) by 0 days.

(21) Appl. No.: 10/857,386

(22) Filed: May 28, 2004

(51) Int. Cl.[7] ..... A47C 19/02
(52) U.S. Cl. ..... 5/53.1; 5/308
(58) Field of Search ..... 5/53.1, 51.1, 2.1, 5/279.1, 308, 907; 312/238

(56) References Cited

U.S. PATENT DOCUMENTS

| | | | | | |
|---|---|---|---|---|---|
| 2,495,494 | A | * | 1/1950 | Ziegenfuss | 5/2.1 |
| D162,492 | S | * | 3/1951 | Tarlazzi | D6/336 |
| 2,602,937 | A | * | 7/1952 | Frey | 5/8 |
| 2,691,174 | A | * | 10/1954 | Harrison | 5/3 |
| 2,806,228 | A | * | 9/1957 | Ziegenfuss | 5/8 |
| D181,844 | S | * | 1/1958 | Frey | D6/336 |
| 2,886,830 | A | * | 5/1959 | Iaquinta | 5/2.1 |
| 2,904,796 | A | * | 9/1959 | Frey | 5/2.1 |
| 3,015,112 | A | * | 1/1962 | Wachsman | 5/8 |
| 3,058,123 | A | * | 10/1962 | Pink et al. | 5/2.1 |
| D262,169 | S | * | 12/1981 | Sonder et al. | D6/439 |
| 4,728,161 | A | * | 3/1988 | Murphy | 312/238 |
| 5,152,592 | A | * | 10/1992 | Krayer | 312/238 |
| 5,335,962 | A | * | 8/1994 | Gera | 297/232 |
| 5,615,936 | A | * | 4/1997 | Simmons et al. | 312/238 |
| D405,623 | S | * | 2/1999 | Zaidman et al. | D6/422 |
| 5,913,769 | A | | 6/1999 | Byma et al. | |
| 5,983,420 | A | | 11/1999 | Tilley | |
| 6,292,960 | B1 | | 9/2001 | Bowling | |
| D471,376 | S | * | 3/2003 | Cizmar | D6/426 |
| D471,733 | S | * | 3/2003 | Cizmar | D6/426 |
| 6,675,408 | B1 | * | 1/2004 | Mason | 5/2.1 |

* cited by examiner

*Primary Examiner*—Robert G. Santos
(74) *Attorney, Agent, or Firm*—Womble Carlyle Sandridge & Rice, PLLC

(57) ABSTRACT

A corner headboard formed of a three sided structure that may be positioned in a corner of the room with the bed extending angularly therefrom.

7 Claims, 6 Drawing Sheets

CORNER BED ARRANGEMENT

BACKGROUND OF THE INVENTION

In the past imaginative people have utilized various room arrangements for residential situations. In certain arrangements, furniture is placed angularly with respect to the walls or corners, rather than parallel or perpendicular thereto. In the case of bedrooms or dormitory rooms, however, the placement of a bed extending angularly from a corner presents a large wasted space behind the headboard.

The problem with the configuration as described pertains to the headboard. When an interior decorator or consumer determines that the bed ensemble should be situated in the corner of a room, facing outward at 45 degrees from the adjacent walls, there is a wasted space behind the headboard, specifically an empty triangle of space from the floor to the ceiling.

It is well known throughout the furniture industry that a headboard is a common and integral item in most bedroom furniture ensembles, whether or not it matches the other pieces of furniture in the room. The headboard typically receives a bed frame, which supports a mattress, box spring or the like. The headboard often is connected to a footboard of similar aesthetic design by way of side rails which support the mattress configuration. Most commercial headboards and/or footboards are slotted or have openings to accommodate either of these methods of mattress support. The headboard is most often designed purely as a decorative transition between the bed and the flat, unadorned wall space above the head of the bed. The footboard is typically a design of little purpose than to follow the aesthetics of the headboard, thereby creating a sculptured design to the entire bed configuration. Generally, however, both the headboard and the footboard have little functional purpose, and rarely provide any storage capacity.

Another problem occurs when placing a headboard and mattress in the corner of a room. In a typical arrangement nightstands, night tables, bedside tables, or the like, accompany a bed, on one or both sides of the headboard. Previously, bedside tables have commonly been square or rectangular, and may or may not include storage capability. A headboard and mattress configuration placed in a corner does not provide a proper configuration for rectangular night tables as previously known, as the resulting floor space on either side of the corner configuration is triangular in shape.

These and other situations are addressed by the present invention.

SUMMARY OF THE PRESENT INVENTION

Thus, in its broadest aspect, the present invention is directed to a corner headboard for use with a bed frame and mattress set. The headboard is configured as a three-sided structure with the two short sides forming a right angle corner junction. The third longer side (sometimes hypotenuse) is approximately the same length and is coextensive with the upper end of the bed frame and mattress set. The corner junction is then placed in the corner of the room with the bed extends angularly therefrom. The headboard itself may include a chest, shelves, and the like, thus eliminating the wasted space.

The invention herein is directed to beds of any standard size, with or without a decorative headboard and bed frames or rails with mattress assemblies, with or without footboards. The present invention, in its preferred form, fits into the corner of a room making it possible for a bed to be placed against or secured to the exposed hypotenuse or long side of the structure. As the headboard may be configured with a chest, shelves or the like, any waste of floor space normally found behind a bed placed in such a position is eliminated. To further save floor space, a nightstand or tall cabinet also having a triangular form may be placed into the space on either side of the bed, preferably with the long side or hypotenuse thereof perpendicular to the wall, thus saving floor space and creating an aesthetically pleasing design effect.

Alternatively, the triangular night table may be situated in such a manner that the hypotenuse or long side of the triangle is turned to face the bed. Thus, one right angle side is positioned against the wall thereby creating a 90 degree space from the wall to the side of the night table. In this configuration, rectangular or square furniture pieces can be placed squarely against the night table thereby creating a wrapping or bunching effect.

As a further alternative, a triangular top panel or bridge can be attached to the top of the entire assembly thereby connecting the tall cabinets on both sides of the corner headboard, as well as the side walls of the corner headboard creating one singular furniture item therein defined as a corner bed-wall. Also, in another form a tall corner headboard may be utilized with a double bunk bed.

The above-mentioned features of the invention will become more clearly understood from the following detailed description of the invention read together with the drawings in which.

DETAILED DESCRIPTION OF THE INVENTION

Figure 1:
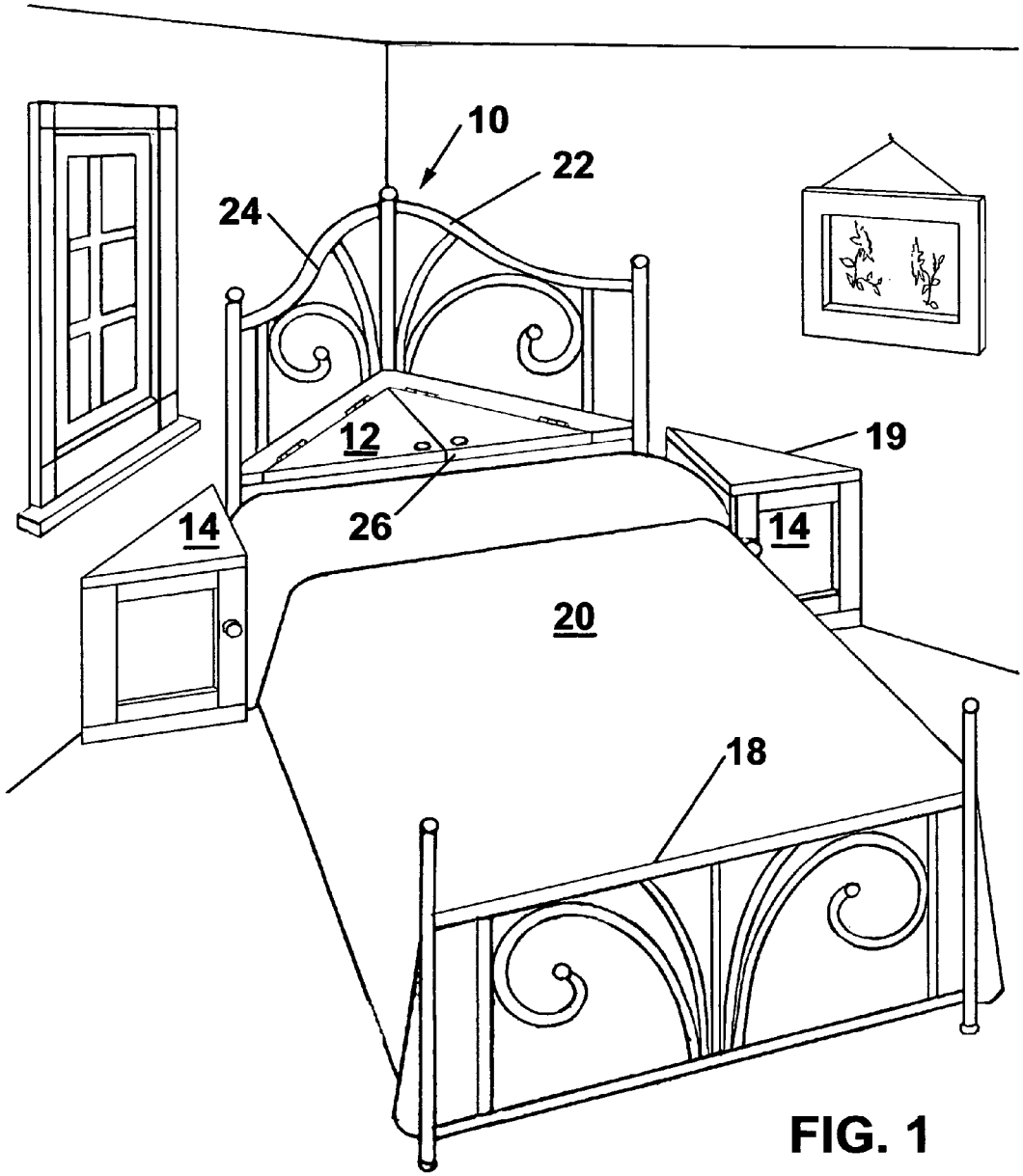
FIG. 1 is a perspective view illustrating a headboard according to the present invention with a bed frame and mattress attached and a pair of side tables.
Figure 2:
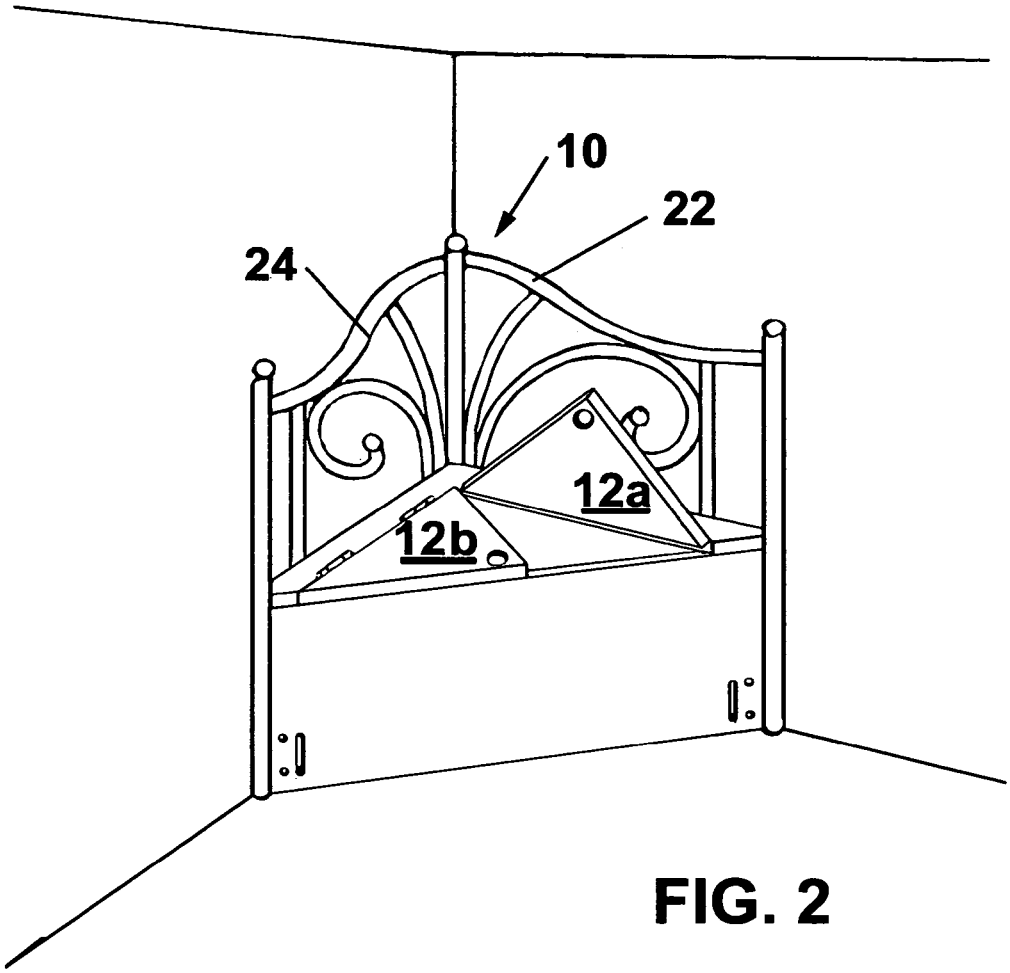
FIG. 2 is a perspective view of the headboard of FIG. 1 alone.

Referring now to the drawings, there is illustrated the invention in FIGS. 1 and 2 which illustrate a bed in its intended environment (corner of a room) having a corner-type headboard 10, an ornamental footboard or foot rail 18 and a pair of triangular side tables 14. While the headboard 10 is illustrated in a decorative metal configuration, it may be wooden, polymeric, or of any other material. The headboard 10 is a three-sided structure with two short sides 22, 24 forming a right angle corner junction and the third side 26 being the longest side and against which a bed frame is placed. As illustrated in FIG. 1, the third side 26 is illustrated as having a length approximately the same as the width of the bed frame, however these relative dimensions may vary. The headboard is adapted to be placed into the corner of a room, so that the bed extends angularly therefrom into the central area of the room.

If desired the three sides may be joined by a triangular platform or shelf 12. In the simplest and most cost-effective design, the shelf is plain and unadorned and serves no other purpose than just that, a shelf. As illustrated in FIG. 2, however, the shelf 12 may be made in two halves 12*a*, 12*b*, which are hinged to the sides 22, 24 respectively. In this manner, a storage area 28 is formed beneath platform 12 with access provided by lifting one or the other of the triangular shelf portions 12*a*, 12*b*.

The triangular night tables 14 are preferably decorated in a manner complementary to headboard 10 as illustrated in FIG. 1. The night tables also have two sides forming a right angle. The hypotenuse or long side 19 of the triangular night tables may be placed against the wall so that the front portions thereof are generally perpendicular to the side of the mattress 20.

Alternatively, although not shown, the night tables may be positioned so that the hypotenuse is against the bed. In such case the exposed side of the night table 14 will be perpendicular to the wall. Also, in another variation one or both of the acute angle corners may be cut away slightly to present a slightly "squared off" look.

The front wall 26 of the headboard 10 is provided with slots or openings 27 to receive the lug bolts or side rail locking tabs of a bed frame in a conventional manner. While not absolutely necessary, the third wall 26 is approximately the same height from the floor as the mattress when made with a pillow and bed linens, so that the platform 12 is about the same height as the upper surface of the pillows. In such a configuration, the sides 22, 24 extend upwardly to a higher elevation, so that the headboard adornment may be displayed.

Figure 3:
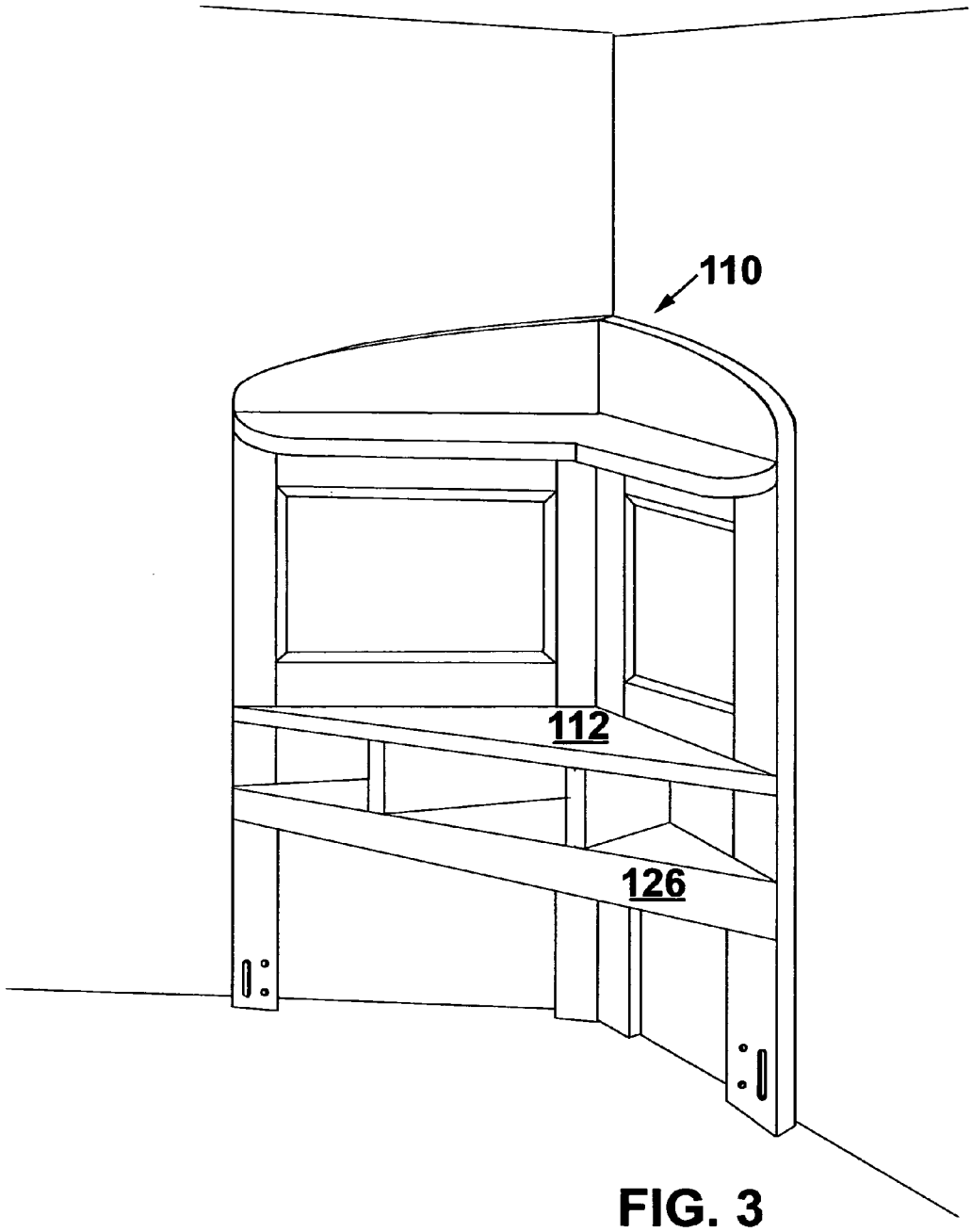
FIG. 3 is a perspective view of an alternative style of headboard.

Turning now to FIG. 3, there is illustrated a first alternative embodiment in which the headboard 110 is primarily made of wood. As such, there may be provided shelves and/or cubby holes above the triangular platform 112. While the headboard of FIG. 3 is illustrated with a different ornamental or aesthetic effect, the concept is still the same. Notice however, that in FIG. 3, the third side does not have a lower wall per se, however only a connecting member 126.

Figure 4:
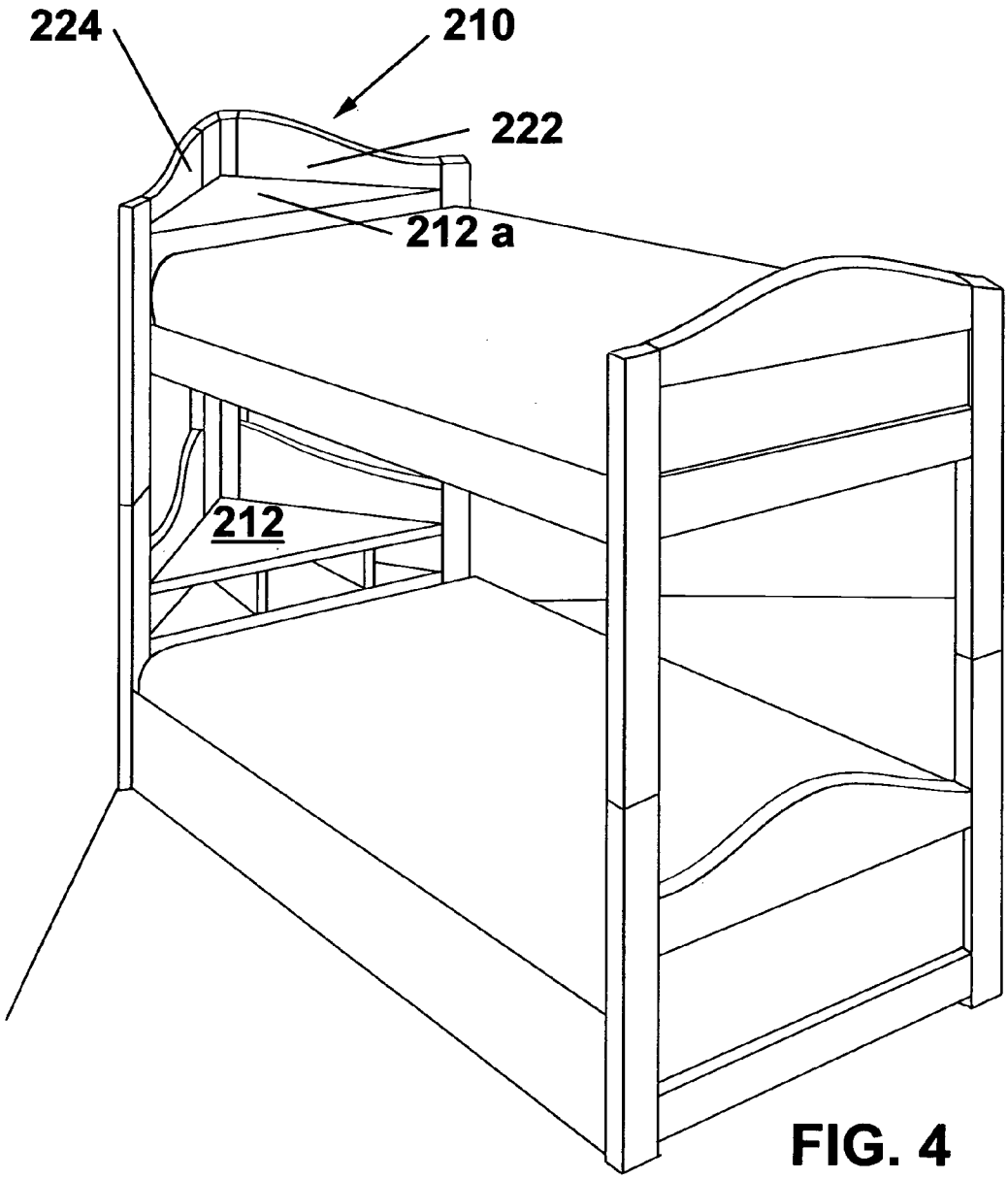
FIG. 4 is a perspective view illustrating another alternative headboard for bunk beds.

Turning now to FIG. 4, there is illustrated the bunk bed approach which features a headboard 210 having extended sides 222, 224 and a second shelf 212*a* in addition to the primary or lower shelf 212. So arranged a pair of bed frames may be secured to the corner headboard 210.

Figure 5:
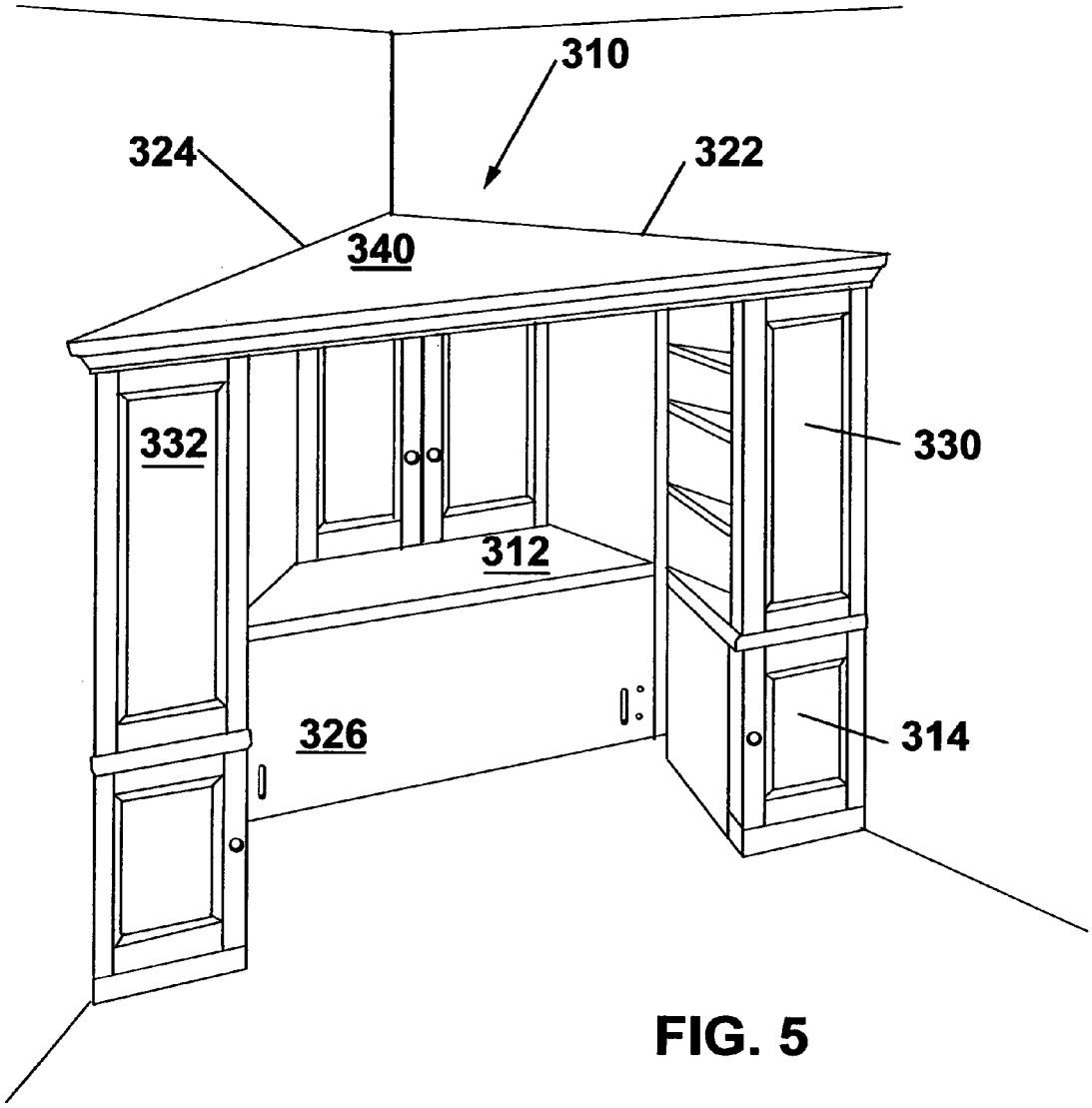
FIG. 5 is perspective view of yet another style of headboard.

FIG. 5 is illustrative of a headboard 310 having side members 322, 324, shelf 312 and third side 326. In this embodiment the side tables 314 include upwardly extending side cabinets 330, 332. Both the side tables 314 and the side cabinets 330, 332 are triangularly shaped, and, as illustrated, side cabinets 330, 332 have shelves that are accessible from the inside surface rather than from the front. So arranged, this alternate embodiment provides a more "enclosed" feeling to the occupants of the bed. Also, it should be noted that there is an upper shelf or bridge 340 which is triangular in shape and may include built-in lights if desired.

Figure 6:
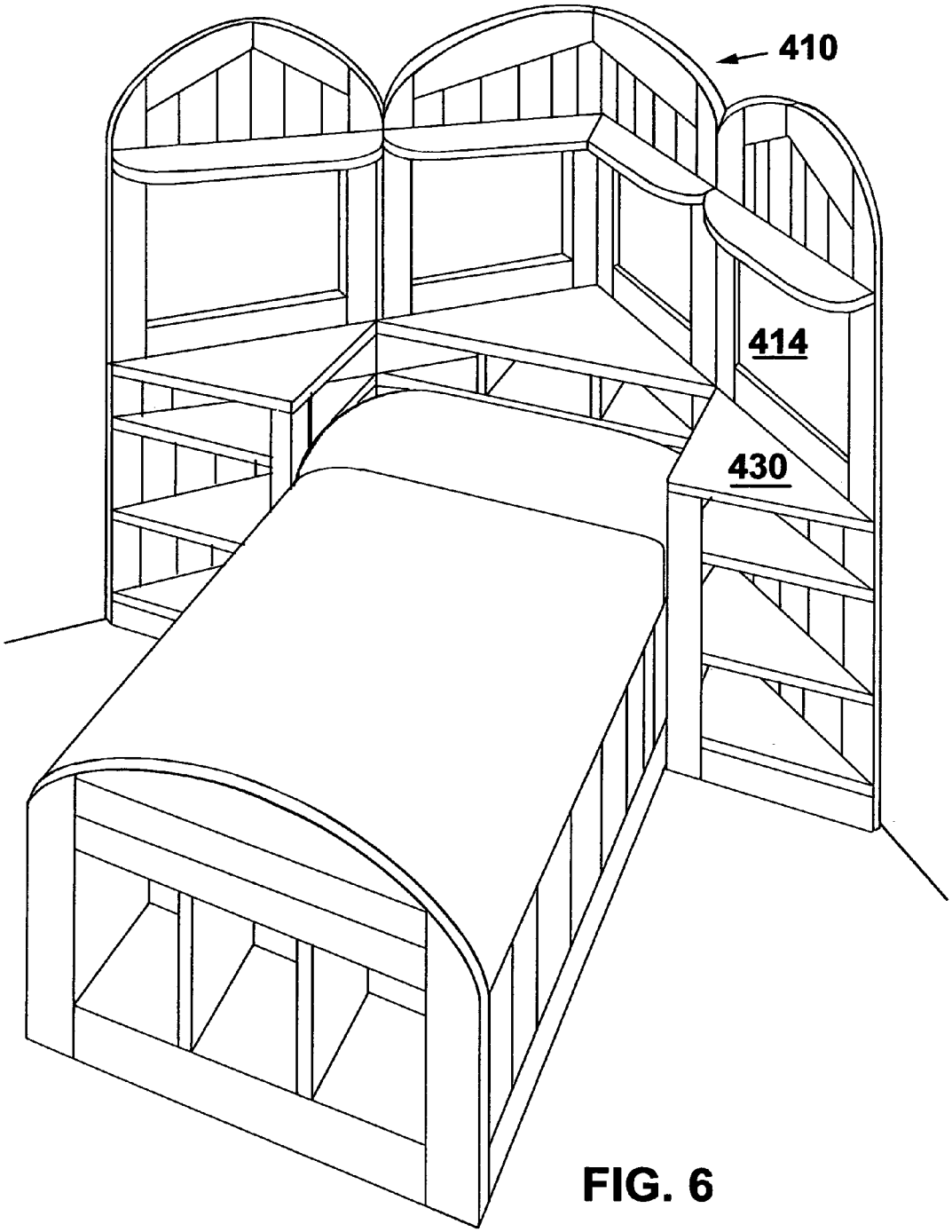
FIG. 6 is a perspective view of still another style of headboard, side tables, and footboard.

Yet another embodiment is illustrated in FIG. 6 in which the headboard 410 is somewhat similar to the configuration of FIG. 3, however side shelf units 414 replace the side tables of the earlier embodiments. The shelf units 414 are configured with a plurality of shelves accessible from the front, and each shelf unit includes a triangular shelf 430 which can be used for lamps, or for placement of personal belongings of the occupants during the evening.

The above figures are merely illustrative of various arrangements, ornamentation, and configurations which the concept of the present invention may occur. However, the primary concept of the present invention is the three sided structure of the headboard which is adapted for emplacement in the corner of a room, with the space therearound utilized in a convenient and attractive manner.

While a preferred embodiment has been shown and described, it will be understood that it is not intended to limit the disclosure, but rather it is intended to illustrate various modifications and alternate methods falling within the spirit and scope of the invention, which is defined in the appended claims.

What is claimed is:

1. A corner headboard for use with a conventional bed frame and mattress set comprising:

a three sided structure with two short sides having flat exterior surfaces forming a right angle corner junction, the third side being the longest side forming a flat wall against which a conventional bed frame is received, the length of the third side being approximately the same as the width of the conventional bed frame with which it is to be used, whereby the corner junction may be positioned in a corner of a room with the bed frame extending angularly into the room from the third side.

2. The corner headboard according to claim 1 wherein a horizontal platform extends between the two short sides and the third longer side at an elevation at least as high above the floor as the upper surface of the mattress.

3. The corner headboard according to claim 2 wherein the two shorter sides extend upwardly significantly above the height of the platform and are esthetically designed.

4. The corner headboard according to claim 2 wherein the area between the shorter sides, the third side, and below the platform are enclosed to form a storage space and the platform includes two triangular halves, each hinged to one of the sides and openable to gain access to the storage space from above.

5. The corner head board according to claim 1 and further including at least one substantially triangular bedside table with one side coextensive with one of the short sides of the headboard, one side adjacent the bed frame and mattress set, and the third side forming the face of the bedside table.

6. The corner head board according to claim 1 wherein the third side includes a connector arrangement for attaching the upper end of the conventional bed frame thereto.

7. The corner headboard according to claim 1 and further including an aesthetically adorned footboard.

* * * * *